US005225630A

United States Patent [19]

Hopkinson et al.

[11] Patent Number: 5,225,630

[45] Date of Patent: Jul. 6, 1993

[54] TRANSFORMER ASSEMBLY HAVING COOLING FINS AND METHOD OF PROVIDING SAME

[75] Inventors: Philip J. Hopkinson, Waukesha, Wis.; Kenneth R. Beck, Manchester, Mo.

[73] Assignee: Cooper Power Systems, Inc., Houston, Tex.

[21] Appl. No.: 716,784

[22] Filed: Jun. 18, 1991

[51] Int. Cl.[5] ..... H01F 15/06

[52] U.S. Cl. ..... 174/16.1; 174/16.3; 336/59; 336/61; 361/379

[58] Field of Search ..... 174/16.1, 16.3; 336/59, 336/61; 361/379

[56] References Cited

U.S. PATENT DOCUMENTS

| | | | |
|---|---|---|---|
| 1,477,792 | 12/1923 | Wagner | 174/16.1 |
| 2,485,745 | 10/1949 | Koonz | 174/16.3 |
| 3,152,217 | 10/1964 | Balchaitis | 174/16.3 |
| 3,361,867 | 1/1968 | De Ridder et al. | 336/61 |
| 3,467,929 | 9/1969 | Derbyshire et al. | 336/61 |
| 3,541,487 | 11/1970 | Leonard | 336/58 |
| 3,614,693 | 10/1971 | Frey, III | 336/61 X |
| 3,659,239 | 4/1972 | Marton | 336/61 |
| 3,731,243 | 5/1973 | Davis | 336/61 |
| 4,085,395 | 4/1978 | Billerbeck et al. | 336/61 |
| 4,446,916 | 5/1984 | Hayes | 174/16.3 |
| 4,496,923 | 1/1985 | Lenzing | 336/61 |

FOREIGN PATENT DOCUMENTS

| | | | |
|---|---|---|---|
| 180803 | 6/1922 | United Kingdom | 174/15.1 |

*Primary Examiner*—Morris H. Nimmo

*Attorney, Agent, or Firm*—Burns, Doane, Swecker & Mathis

[57] ABSTRACT

A transformer assembly comprises a tank body enclosing a transformer and a cooling liquid. A cooling collar is fixedly attached to the outer surface of the tank body. The cooling collar is formed separately from the tank body in a corrugated shape so as to be elastically expandably mounted onto the tank body. The collar is attached to the tank body by a thermally conductive epoxy. The corrugations of the collar define cooling fins for dissipating heat from the tank body. The cooling collar can be of one-piece or multi-piece construction, the latter comprising a plurality of collar segments hooked together in end-to-end fashion.

16 Claims, 3 Drawing Sheets

FIG. 1
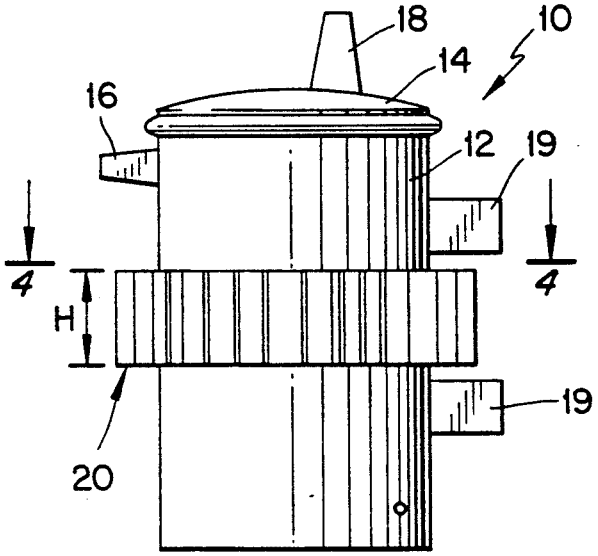
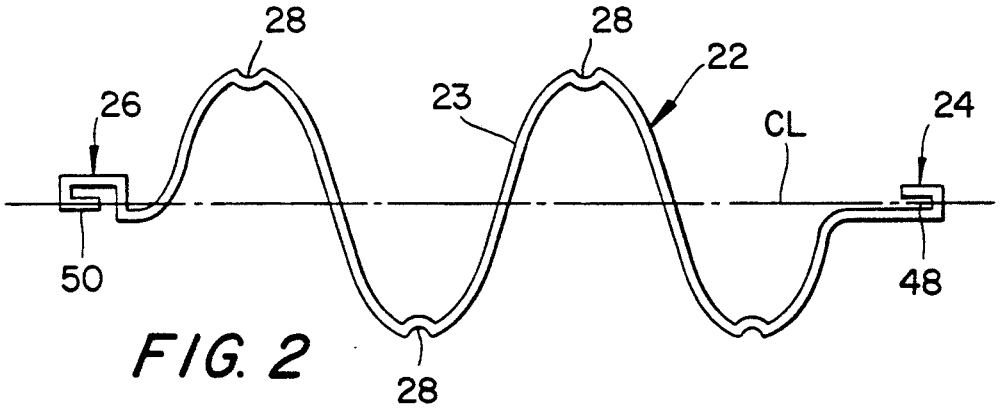
FIG. 2
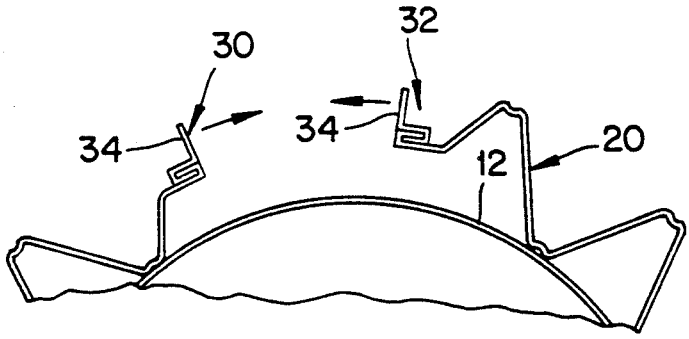
FIG. 3

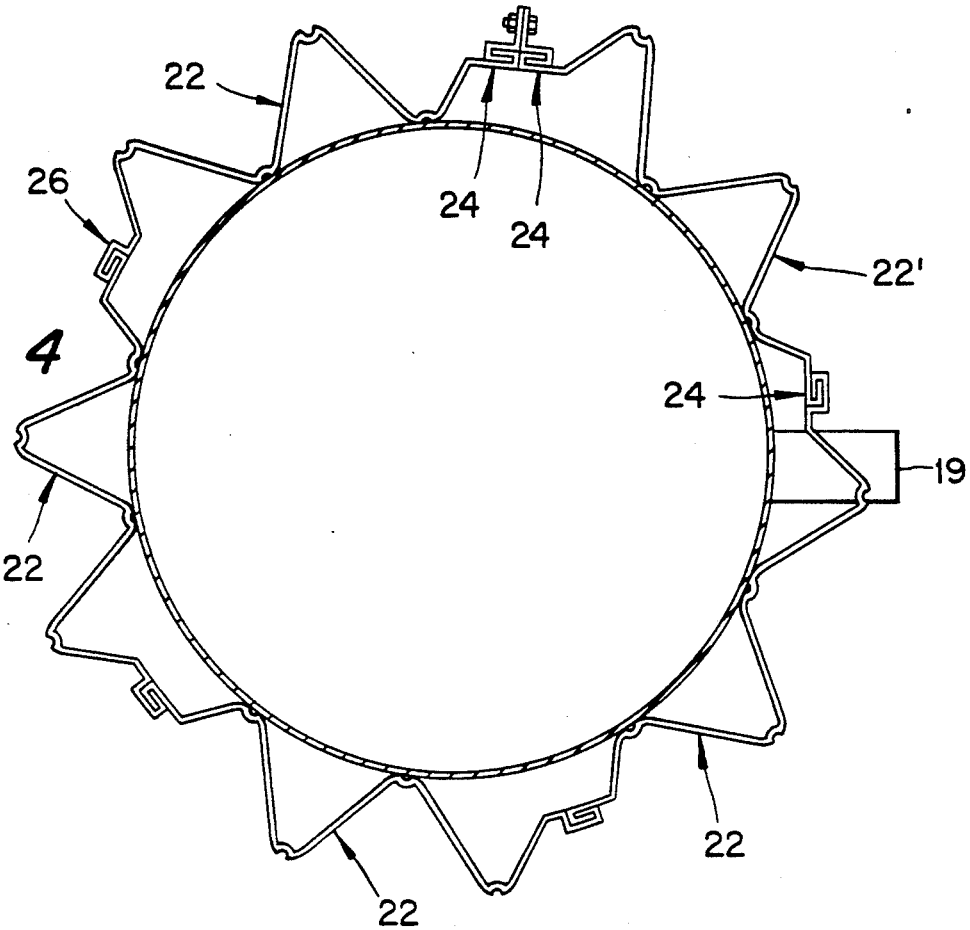
FIG. 4
FIG. 5
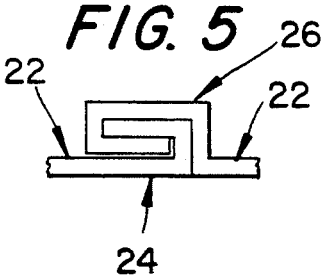
FIG. 6
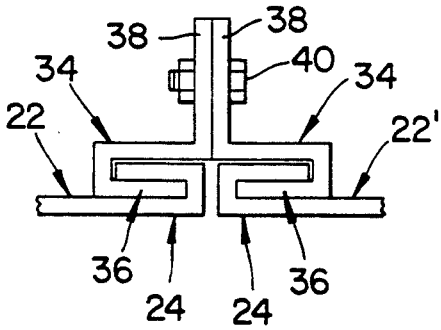
FIG. 7
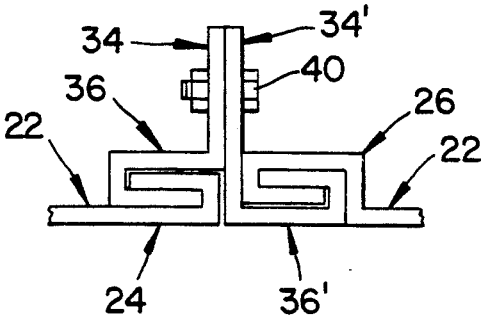

TRANSFORMER ASSEMBLY HAVING COOLING FINS AND METHOD OF PROVIDING SAME

BACKGROUND OF THE INVENTION

The present invention relates to electrical transformers and, in particular, to the cooling of distribution transformer tanks.

A transformer tank typically comprises a cylindrical body and top and bottom plates for sealing therein a transformer and cooling liquid. Low and high voltage leads protruding from the body are adapted to connect the transformer to external low and high voltage lines. The heat generated during operation of the transformer is absorbed by the cooling liquid and conducted through the wall of the tank for dissipation to atmosphere. The rate at which the heat is dissipated, i.e., the cooling capacity, is an important aspect of transformer performance, because the greater the cooling capacity, the higher the efficiency and loadability of the transformer.

In order to improve the cooling capacity of a transformer tank, it has heretofore been proposed to provide the exterior surface of the tank with heat exchanger fins. For example, in U.S. Pat. No. 3,361,867, it has been proposed to form a tank body of multiple sections which are integrally formed with fins on the outside surface. The sections are interconnected to form the tank. The implementation of such a proposal, however, would increase the cost and complexity of manufacturing and assembling the tank, and would not be suited to the retro-fitting of existing tanks. Even if the fins were, instead, formed separately and welded to the outside surface of the tank, the weld joints would be susceptible to corrosion.

It would, therefore, be desirable to be able to enhance the cooling capacity of new and existing transformer tanks in a relatively simple and economical manner.

SUMMARY OF THE INVENTION

The present invention relates to a transformer assembly comprising a tank body for enclosing a transformer and a cooling liquid. The tank body includes an outer peripheral surface and a cooling collar fixedly attached to the outer surface of the tank body. The cooling collar is formed separately from the tank body and is elastically expandably mounted onto the tank body such that the cooling collar is inherently spring-biased against the outer peripheral surface of the tank body. The cooling collar includes circumferentially spaced apart cooling fins for dissipating heat from the tank body.

Preferably, the cooling collar is fixedly bonded to the outer surface of the tank body by a thermally conductive epoxy.

Preferably, the cooling collar is of corrugated configuration to define the cooling fins.

The cooling collar preferably comprises a plurality of segments connected in end-to-end fashion, the segments possessing corrugations which are bonded to the tank body by the epoxy.

In another aspect of the invention, a transformer assembly comprises a tank body for enclosing a transformer and a cooling liquid. The tank body includes an outer peripheral surface. A corrugated cooling collar, formed separately from the tank body, is mounted thereon. Circumferentially spaced corrugations of the collar are bonded to the outer peripheral surface by a thermally conductive epoxy. The corrugations define cooling fins for dissipating heat from the tank body.

The present invention also involves a method of increasing the cooling capacity of a transformer tank body which encloses a transformer and a cooling liquid. The method comprises the steps of providing a cooling collar having a plurality of spaced apart cooling fins. The cooling collar is mounted onto the outer periphery of the tank body and is fixedly attached thereto by a thermally conductive epoxy.

Preferably, the cooling collar is elastically expanded around the outer surface of the tank body, whereby the cooling collar is inherently spring-biased against the outer peripheral surface. The cooling collar is preferably formed by connecting together a plurality of collar segments in end-to-end fashion.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a side elevational view of a transformer tank body having mounted thereon a cooling collar according to the present invention;

FIG. 2 is an edge view of a segment of a cooling collar according to one embodiment of the invention;

FIG. 3 is a fragmentary view of a cooling collar comprised of a plurality of collar segments in the process of being expanded around the outer periphery of the tank bodies;

FIG. 4 is a cross-sectional view taken along the line 4—4 in FIG. 1 after the cooling collar of FIG. 3 has been mounted thereon;

FIG. 5 is an enlarged fragmentary view of an interconnection between two of the collar segments;

FIG. 6 is an enlarged fragmentary view of connecting members utilized to connect the ends of the cooling collar together;

FIG. 7 is a view similar to FIG. 6 of an alternate arrangement of connecting members;

DETAILED DESCRIPTION OF A PREFERRED EMBODIMENT OF THE INVENTION

Figure 8:
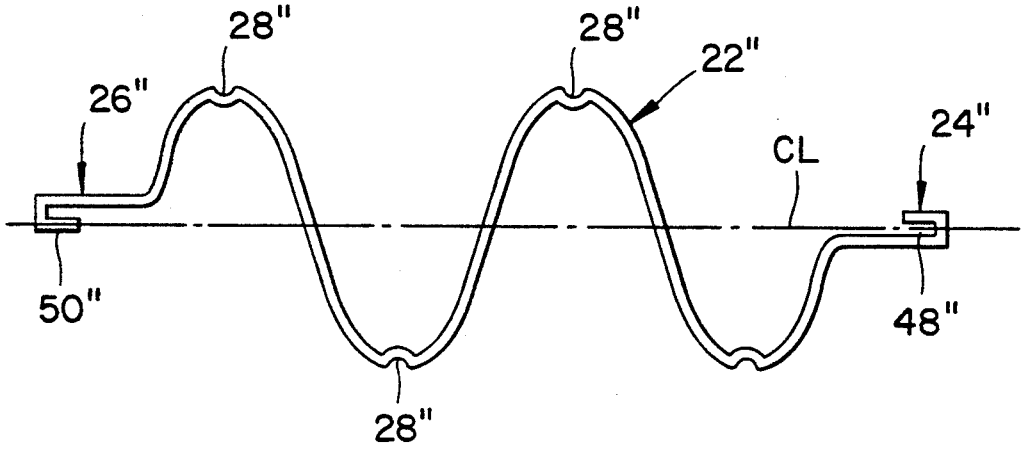
FIG. 8 is an edge view of an alternative embodiment of a cooling collar segment according to the present invention.

A conventional transformer assembly 10 depicted in FIG. 1 includes a tank 12 in the form of a cylindrical body which is closed off at its ends by a lid 14 and a bottom (not shown), whereby the tank can enclose a conventional transformer and cooling liquid therefor. Preferably, the transformer assembly 10 is a pole type distribution transformer.

Low and high voltage leads 16, 18 project from an outer peripheral surface of the body for connecting the transformer to external low and high voltage lines. Lifting lugs 19 are provided to enable the transformer to be transported.

During operation of the transformer, generated heat is absorbed by the cooling liquid and conducted through the wall of the body from which it is dissipated to the atmosphere by convection.

A cooling collar 20 is formed separately of the tank and attached thereto The cooling collar 20 is formed of a plurality of identically configured collar segments 22 (see FIG. 2) which are hooked together in end-to-end relationship and stretched to fit around the circumference of the tank 12. Each collar segment 22 comprises a convoluted or corrugated strip of metal, the ends of which are shaped as 24, 26. Each of the hooks 24, 26 is formed by suitably bending the end of the strip.

The collar segment 22 contains any suitable number of convolutions or corrugations 23 arranged in a sine wave-like configuration. At the outer apex of each corrugation, the strip is deformed to define a pocket 28 adapted to receive an epoxy resin as will be explained later in more detail.

The segment 22 has a height H (FIG. 1) determined in accordance with the shape of the tank body, so that the installation of the collar 20 can be installed without contacting projections of the body (e.g., such as the lifting lugs 19).

In order to install the collar 20, a plurality of the collar segments 22 are hooked together (as shown in FIG. 5), and the thus-formed collar is wrapped around the outer periphery of the tank body. The innermost circumference of the collar when in a relaxed state is less than the outer circumference of the tank body (see FIG. 3). By stretching the collar, the ends 30, 32 thereof can be joined together. In so doing, the individual segments 22 are stretched and thereafter exhibit an inherent bias against the outer periphery of the tank body.

Prior to the wrapping of the collar around the tank body, the ones of the pockets 28 which are to face the tank body are filled with a thermally conductive epoxy adhesive. Thus, upon subsequent wrapping of the collar around the tank body, the epoxy contacts the tank body and collar segments to bond the collar to the tank body as well as to promote the conduction of heat from the tank body to the collar. The provision of pockets 28 at the apexes of all of the convolutions means that the collar can be bent in either direction to fit against the tank body Any suitable commercially available thermally conductive epoxy can be used for that purpose, such as a thermally conductive elastomer sold by Dow Corning under the product designation Q3-6605.

The corrugations of the collar define circumferentially spaced apart cooling fins which present a relatively large surface area to the ambient air in order to maximize the convection of heat from the collar to the air.

The ends of the collar are interconnected by means of connecting members 34 (FIG. 6), each of which includes a hook 36 and a flange 38. The flanges 38 are joined by a fastener such as one or more bolts 40. If the two connecting members 34 are to be of identical construction, as depicted in FIGS. 3, 4 and 6, then a collar segment 22' defining one of the ends of the collar should be different from the remaining segments in that it should possess two identical hooks 24 at its ends as depicted in FIG. 4. (In contrast each of the remaining segments 22 has differently shaped hooks 24, 26.)

Alternatively, if all of the collar segments 22 are to be of identical configuration, i.e., each segment possessing hooks 24 and 26, then the connecting members would be different, as depicted in FIG. 7. Depicted therein is a first connecting member 34 similar to that depicted in FIG. 6, and a second connecting member 34' whose hook 36' is different from that of the first connecting member 34, in order to accommodate the hook 26 of the associated collar segment 22.

It would also be possible to eliminate the use of separate connecting members by simply stretching the collar sufficiently to engage the hook located at one end of the collar directly with the hook located at the other end of the collar.

Another preferred collar segment 22" is depicted in FIG. 8 wherein the hooks 24" and 26" are similar but are inverted relative to one another.

Attention is directed to the fact that a center line CL through a collar segment (see FIGS. 2 and 8) passes through the recess 48 (or 48") of one of the hooks and through the outer leg 50 (or 50") of the other hook so that when the segments are connected together, their center lines CL will be in alignment.

Figure 9:
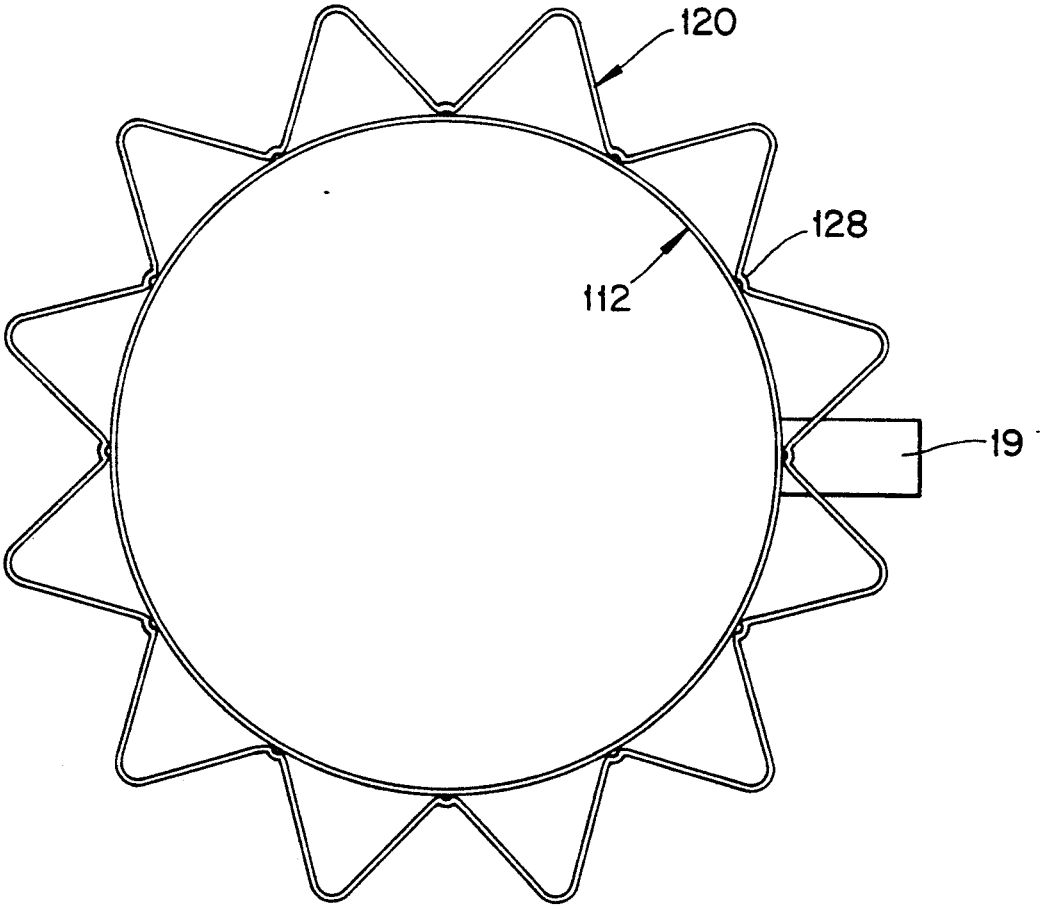
FIG. 9 is a view similar to FIG. 4 depicting another embodiment of a cooling collar according to the present invention.

Yet another preferred form of cooling collar 120 is depicted in FIG. 9. Instead of being formed of interlinked segments, the corrugated collar 120 is formed of one-piece. The corrugated configuration renders the collar elastically expandable in the diametrical direction, whereby the inner diameter can be expanded.

The tank body 112 is formed with a cylindrical outer peripheral surface having a diameter larger than the normal inner diameter of the collar 120 when the collar is in a relaxed state. By elastically expanding the collar 120 until the inner diameter thereof exceeds the outer diameter of the tank outer periphery, the collar can be mounted telescopically over the tank outer periphery. Then the collar 120 is allowed to contract and clamp itself against the tank.

Before allowing the collar to contract, the pockets 128 of the collar 120 are filled with a thermally conductive epoxy. After the collar contracts and the epoxy hardens, the collar will be fixedly attached to the tank body by the combination of the inherent inward bias of the collar and the bond established by the epoxy, similar to the earlier described collar 20.

In use of the transformer assembly, according to the present invention, heat absorbed by the cooling liquid within the tank 12 or 112 is conducted through the tank wall and the epoxy to the cooling collar 20, 20", or 120, whereupon it is dissipated to atmosphere by convection from the cooling fins defined by the corrugations of the collar.

The presence of the cooling fins appreciably increases the outer surface area of the tank, thereby enhancing the tank cooling capacity. Consequently, the winding resistance and power loss of the transformer are reduced, thereby increasing transformer efficiency. Also, the loadability of the transformer (i.e., the amount of electrical loading to which the transformer is subjected) is increased.

It will be appreciated that the enhanced cooling capacity is achieved relatively inexpensively since the tank retains its conventional configuration, and the cost of the collar and its installation is relatively low.

The thermal junction between the collar and tank wall formed by the thermally conductive epoxy provides excellent thermal conductivity and is highly resistant to corrosion. Also, the thermal junction aids in securing the collar to the tank.

Existing transformer tanks can be retro-fit with one or more cooling collars according to the present invention to enhance the heat dissipation characteristics thereof. The cooling collar can also be installed on new transformer tanks.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A transformer assembly, comprising:

a tank body for enclosing a transformer and a cooling liquid, said tank body including an outer peripheral surface, a cooling collar fixedly attached to said outer surface of said tank body, said cooling collar being formed separately from said tank body and being elastically expandably mountable onto said outer peripheral surface of said tank body such that said cooling collar is inherently spring-biased toward said outer peripheral surface, said cooling collar including circumferentially spaced-apart cooling fins for dissipating heat from said tank body.

2. A transformer assembly according to claim 1, wherein said cooling collar is fixedly bonded to said outer surface of said tank body by a thermally conductive epoxy.

3. A transformer assembly according to claim 2, wherein said cooling fins are defined by a corrugated configuration.

4. A transformer assembly according to claim 3, wherein said cooling collar comprises a plurality of segments connected in end-to-end fashion.

5. A transformer assembly according to claim 4, wherein said segments possess corrugations which define said cooling fins, apexes of said corrugations containing pockets in which is disposed thermally conductive epoxy.

6. A transformer assembly according to claim 1, wherein said cooling collar is of corrugated configuration to define said cooling fins are defined by a corrugated configuration.

7. A transformer tank according to claim 6, wherein said fins extend alternately in radially inward and outward directions, and alternate ones of said fins are bonded to said outer peripheral surface of said body by a thermally conductive epoxy.

8. A transformer assembly according to claim 1, wherein said cooling collar comprises a plurality of segments connected in end-to-end fashion.

9. A transformer assembly according to claim 8, wherein said segments possess corrugations which define said cooling fins, apexes of said corrugations containing pockets in which is disposed thermally conductive epoxy.

10. A transformer assembly according to claim 1, wherein said outer peripheral surface is of cylindrical shape.

11. A transformer assembly, comprising;

a tank body for enclosing a transformer and a cooling liquid, said tank body including an outer peripheral surface, and a corrugated cooling collar, formed separately of said tank body, and inserted thereon, said collar including circumferentially spaced corrugations bonded to said outer peripheral surface by a thermally conductive epoxy, said corrugations defining cooling fins for dissipating heat from said tank body.

12. A transformer assembly according to claim 11, wherein said cooling collar comprises a plurality of segments connected in end-to-end fashion.

13. A transformer assembly, comprising:

a cylindrical body closed at its top and bottom ends for enclosing therein a transformer and cooling liquid, high and low voltage leads protruding from said body for making connection with external high and low voltage lines, and a cooling collar formed separately from and mounted on an outside peripheral surface of said body, said cooling collar comprised of a plurality of corrugated segments connected in end-to-end fashion, said segments including corrugations defining cooling fins for dissipating heat, said corrugations rendering said cooling collar elastically expandable for mounting onto said body such that said cooling collar is biased toward said outer peripheral surface of said body, said corrugations being fixedly bonded to said outer peripheral surface of said body by a thermally conductive epoxy.

14. A method of increasing the cooling capacity of a transformer tank body which encloses a transformer and a cooling liquid, said method comprising the steps of:

providing a transformer tank body for enclosing a transformer, providing a cooling collar having a plurality of spaced-apart cooling fins, mounting said cooling collar onto said outer periphery of said tank body, and fixedly attaching said cooling collar to said outer peripheral surface by a thermally conductive epoxy.

15. A method according to claim 14, wherein said cooling collar is elastically expandable, said inserting step including elastically expanding said cooling collar around said outer surface of said tank body, whereby said cooling collar is biased toward said outer peripheral surface of said tank body.

16. A method according to claim 14, wherein said cooling collar is formed by connecting a plurality of collar segments together in end-to-end fashion.

* * * * *